United States Patent [19]

Crick et al.

[11] Patent Number: 5,076,037

[45] Date of Patent: Dec. 31, 1991

[54] DECORATIVE WALL COVER AND METHOD OF INSTALLATION

[75] Inventors: Dallas M. Crick, Pembroke Pines, Fla.; James G. Perkins, Wilmette, Ill.; Douglas F. Hudson, Jr., Miami, Fla.

[73] Assignee: Nailite International, Miami, Fla.

[21] Appl. No.: 488,351

[22] Filed: Mar. 2, 1990

[51] Int. Cl.[5] ..... E04D 1/00

[52] U.S. Cl. ..... 52/520; 52/533; 52/553; 52/555; 52/748

[58] Field of Search ..... 52/748, 558, 533, 543, 52/546, 520, 521, 553, 545, 559, 57, 276, 554, 555

[56] References Cited

U.S. PATENT DOCUMENTS

| | | | |
|---|---|---|---|
| 3,160,245 | 5/1960 | Pavlecka . | |
| 3,217,453 | 11/1965 | Medow . | |
| 3,233,382 | 2/1966 | Graveley . | |
| 3,296,759 | 1/1967 | Pavlecka . | |
| 3,304,667 | 2/1967 | Donegan . | |
| 3,363,380 | 1/1968 | Merrill . | |
| 3,485,002 | 12/1969 | Baker . | |
| 3,605,369 | 9/1971 | Merrill et al. . | |
| 3,613,326 | 10/1971 | Mollman . | |
| 3,667,184 | 6/1972 | Merrill et al. . | |
| 3,686,813 | 8/1972 | Breitweiser et al. . | |
| 3,754,366 | 8/1973 | Jansson et al. . | |
| 3,837,133 | 9/1974 | Mollman . | |
| 3,899,855 | 8/1975 | Gadsby . | |
| 3,927,501 | 12/1975 | Allen et al. | 52/559 X |
| 4,015,391 | 4/1977 | Epstein et al. . | |
| 4,107,885 | 8/1978 | Lindal . | |
| 4,251,967 | 2/1981 | Hoofe . | |
| 4,343,126 | 8/1982 | Hoofe . | |
| 4,423,572 | 1/1984 | Tor . | |
| 4,459,788 | 7/1984 | Bockwinkel . | |
| 4,468,909 | 9/1984 | Eaton | 52/558 X |
| 4,476,661 | 10/1984 | Hoofe . | |
| 4,522,002 | 6/1985 | Davis et al. . | |
| 4,586,304 | 5/1986 | Flamand . | |
| 4,598,522 | 7/1986 | Hoofe . | |
| 4,680,911 | 7/1987 | Davis et al. . | |
| 4,731,970 | 3/1988 | Marshall et al. | 52/660 X |

*Primary Examiner*—David A. Scherbel
*Assistant Examiner*—Robert Canfield
*Attorney, Agent, or Firm*—Leydig, Voit & Mayer

[57] ABSTRACT

A decorative wall covering and method of installation. The wall covering includes a plurality of identically molded panels each having first and second predetermined laterally spaced vertical cutting lines and being formed with horizontal rows of laterally spaced simulated shake. The first panel of each alternate course in the vertical direction is cut along the first cutting line and the first panel of every other course is cut along the second predetermined cutting line, whereby the lowermost row of simulated shake of the panels of each course are automatically offset from the uppermost row of the panels in the course immediately therebelow.

22 Claims, 4 Drawing Sheets

DECORATIVE WALL COVER AND METHOD OF INSTALLATION

DESCRIPTION OF THE INVENTION

The present invention relates generally to roof and wall coverings primarily intended for outdoor usage, and more particularly, to roof and wall coverings comprised of relatively large panels which each are molded or otherwise formed with decorative patterns characteristic of conventional roofing and siding materials such as shake, tile, brick or the like.

Various synthetic roof and wall coverings are known today, such as those formed of elongated thermoplastic panels that are nailed to the wall or roof support surface in horizontal courses or rows in partially overlapping relation to each other so as to provide a substantially water resistant, protective layer over the support surface. Such panels, which usually are identically molded, typically are formed with a plurality of rows of simulated building elements, such as shake shingles. In such panels, the individual simulated shake of each row commonly are molded in laterally spaced relation with a separating groove therebetween. Because the panels are identically formed, a panel-to-panel identity can be easily noticed if the panels are not carefully installed, and heretofore problems have been presented in effectively concealing the joints between adjacently mounted panels. Because the panels are relatively long, such as on the order of 48 inches, and can be exposed to significant temperature variations in the outdoor environment, the panels can thermally expand and contract as much as $\frac{5}{8}$ inch. Hence, the spacing or gap between the last shake of one panel and first shake of the next panel can vary considerably, while the spacing between the individual shake of each panel remains fixed. As a result of such variance in the gaps between shake of adjacent panels the esthetic appearance of the the wall covering can be adversely affected, as well as the seals between the overlapping panels.

In addition, while from a manufacturing economy standpoint it is desirable that the panels of the wall covering be identically molded, if such identically formed panels are similarly mounted on the wall or roof, the simulated shake or like building elements on one panel may align identically with the simulated shake on the panel immediately above or below. This again detracts from the realistic and esthetic appearance of the wall covering. While it has been the practice during installation to cut off a section of the left-hand side of the first panel to be installed in each course so that the simulated shake, and thus the separating grooves therebetween, of the lowermost row of one panel are laterally offset from the simulated shake in the uppermost row of the underlying panel, this has been a tedious procedure, particularly since the simulated shake typically have various widths which results in the separating grooves between the individual shake being randomly located along the length of the panel. Heretofore, considerable time and effort has been necessary in determining where to make the cut in the first panel of each course in order that the separating grooves between rows of simulated shake of underlying panel are spaced an appreciable distance, such as at least $\frac{3}{4}$ inch, so as not to create a noticeable flaw in the appearance of the wall covering. Because of the judgment required in making such cut, which may be dependent upon the skill of the particular installer, the panel-to-panel identity in the completed wall covering may not be effectively concealed. Moreover, excessive waste can result in such cutting of the panels.

It is an object of the invention to provide a decorative wall covering made of plastic molded panels formed with rows of simulated building elements, such as shake shingles, which are adapted for mounting with a more realistic and naturally esthetic appearance.

Another object is to provide a decorative wall covering as characterized above in which the variance in the spacing between simulated shake of adjacently mounted panels caused by thermal expansion and contraction is less noticeable and does not detract from the appearance of the completed wall covering.

A further object is to provide a decorative wall covering of the above kind in which successive courses of panels can be quickly and effeciently mounted on the wall support surface with the simulated shake or other building elements on one panel automatically and esthetically offset laterally from the simulated shake of the panel immediately therebelow.

Still another object is to provide a method for more efficiently installing such wall covering panels to achieve an esthetic appearance without requiring tedius and time consuming judgment by the installer with respect to the manner in which panels are cut to start each course.

Still another object is to provide a decorative wall covering panel formed with a plurality of rows of simulated shake shingles or other building elements and which lends itself to easy, efficient, and economical installation with the separating grooves between the shingles of each row automatically being offset an appreciable distance, such as at least $\frac{3}{4}$ inch, from the separating grooves of the row of simulated shingles on the panel immediately therebelow.

Still another object is to provide a wall and roof panel of the above kind which is of relatively simple construction so as to lend itself to economical manufacture and easy fail proof installation.

Other objects and advantages of the invention will become apparent upon reading the following detailed description and upon reference to the drawings, in which.

Figure 1:
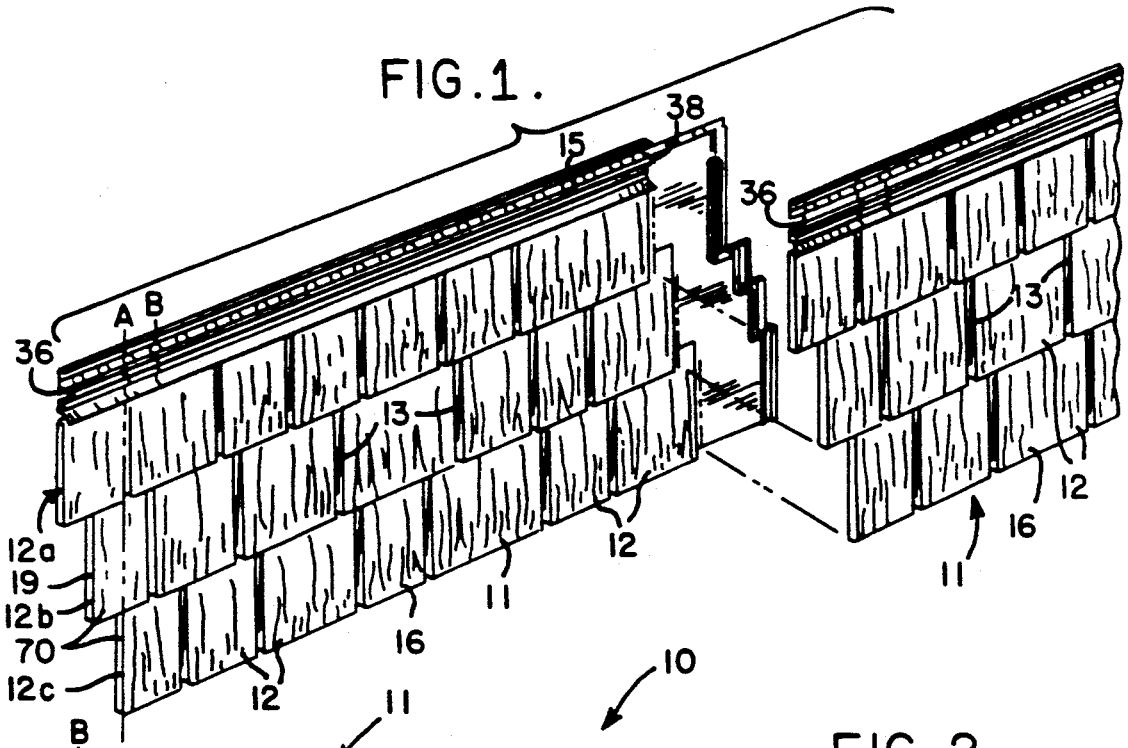
FIG. 1 is a perspective of a pair of panels that form the wall covering of the present invention, with one panel shown in exploded or separated relation to the other.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling with the spirit and scope of the invention.

Referring now more particularly to the drawings, there is shown an illustrative wall covering 10 comprising a plurality of panels 11 embodying the present invention. The panels 11, which preferably are identically molded out of relatively thin-gage rigid plastic material, each are formed with simulated building elements. The panels 11, which may be of a type disclosed in applicants' simultaneously filed application Ser. No. 07/487,910, the disclosure of which is incorporated herein by reference, in this instance are formed with simulated shake shingles 12 of irregular width that are disposed in a plurality of parallel rows of 12*a*, 12*b* and 12*c*. The individual shake on each panel are separated by a groove or gap 13. Because of the irregular widths of the shake, the grooves 13 between the individual shake of each row 12*a*, 12*b*, and 12*c* are randomly located in offset relatin to each other. The illustrated simulated shake pattern is of a type known in the industry as "perfection" shake, wherein the lower edges 14*a*, 14*b*, 14*c* of each row 12*a*, 12*b*, 12*c* are in a substantially straight line.

In order to facilitate mounting of the panels 11 in side-by-side relation with the junctures between adjacent panels less noticeable to the eye, the rows 12*a*, 12*b*, 12*c* of shake 12 of each panel 11 extend in offset relation to each other so as to define stepped left and right-hand sides of the panel. In the illustrated embodiment, the middle row 12*b* of shake extends farther to the right than the first row 12*a* a distance corresponding to about one-quarter to one-half the width of one shake 12, and the bottom row 12*c* extends farther to the right than the middle row 12*b* about a similar distance.

Each panel 11 has an upper horizontal marginal edge region 15 extending across the top of the panel immediately above the top row 12*a* of shake 12 (FIG. 3), a lower marginal edge region 16 which defines a lower peripheral edge of the panel, a side marginal edge region 18 of non-uniform but generally similar width as the upper marginal edge region 15, and in this instance, located to the right-hand side of the last simulated shake 12 in each row 12*a*, 12*b*, and 12*c*, and a marginal edge region 19 on the opposite side of the panel 11 which defines a left-side peripheral edge immediately adjacent the first simulated shake of each row 12*a*, 12*b*, 12*c*. Because of the staggered relationship of the rows 12*a*, 12*b* and 12*c* of simulated shake, the side marginal edge regions 18, 19 are similarly staggered.

Figure 7:
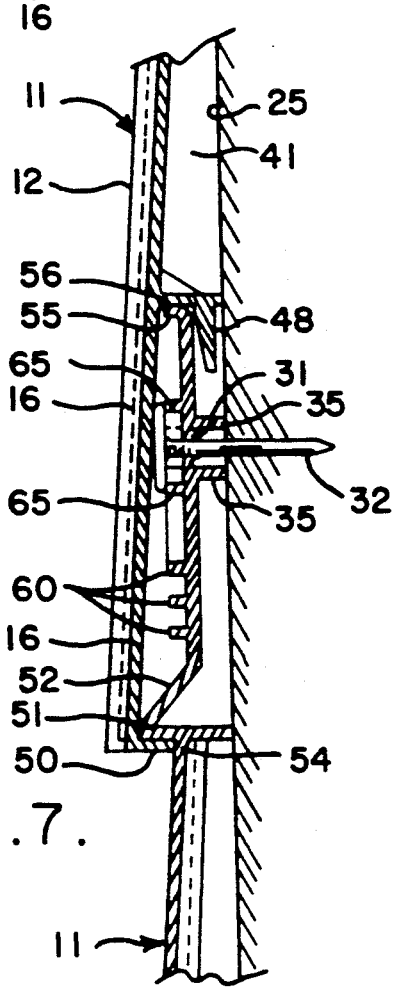
FIG. 7 is an enlarged fragmentary section showing the overlapping lower and upper marginal edge regions of panels of the illustrated wall covering.
Figure 9:
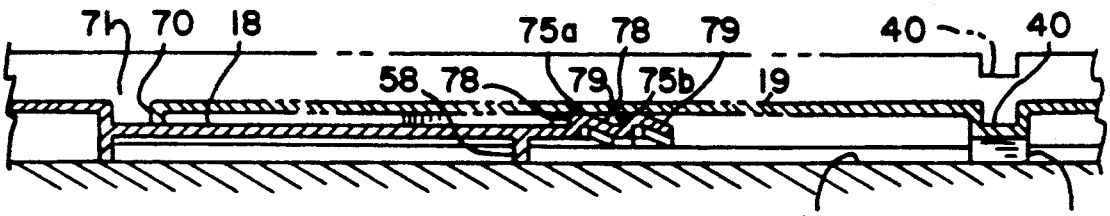
FIG. 9 is an enlarged fragmentary section of the right marginal edge region of the illustrated panel taken in the plane of line 9—9 in FIG. 8 and showing the left marginal edge region of an adjacent panel in mounted relation thereto.

To facilitate nailing of the panels 11 to a support surface 25 of a wall or roof, the upper marginal edge region 15 of each panel is formed with a plurality of elongated laterally spaced nailing apertures 30. To enhance the water barrier features of the wall covering 10, as will become apparent, the nailing apertures 30 preferably are covered with a thin plastic flashing 31 during the molding process (FIGS. 7 and 9). Upon nailing each panel 11 to the support surface 25, the nail 32 will pierce the flashing 31, with the flashing 31 maintaining a relatively tight seal about the nail.

To provide for stable mounting of each panel 11 on the support surface 25, the gaps or grooves 13 between each simulated shake 12 on the face of the panel 11 define rigidifying and support ridges 41 on the underside of the panel for positioning directly onto the support surface 25. While each simulated shake 12 has a downwardly and outwardly tapered outer face to simulate the appearance found in natural shake, the supporting ridges 41 each have a rear face adapted for flush mounting against the support surface 25.

The panels 11 preferably are mounted on the wall or roof beginning with the left-hand panel of the lowermost course to be installed, as is known in the art. For this purpose, a starting strip of a conventional type may be provided along the starting edge. The panels 11 of each course are successively nailed to the support surface, utilizing the nail apertures 30 in the upper marginal edge region 15, with the left-side marginal edge region of each panel being positioned in overlapping relation on the right-side marginal edge region of the previously mounted panel. Upon completion of the first course, the second or next course up, is similarly nailed to the support surface with the lower marginal edge region of each panel overlapping the upper marginal edge region of the panel in the course immediately below.

Prior to mounting the first panel of each course, it has been customary in the art to cut off a left-hand portion of the panel for the purpose of removing the staggered end and varying the starting point of the first panel relative to the straight starting edge of the support surface 25 so that the simulated shake 12 of the lowermost row 12*c* of the panel being mounted do not align directly with the top row of simulated shake in the panel immediately therebelow, which can detract from the appearance of the completed wall covering. The first panel 11 in each course typically is cut at a different location along a left-hand side by trial and error until the simulated shake 12 of the panel are considered sufficiently offset from the simulated shake of the panel in the course below. Heretofore, as indicated above, this often has been a tedious and time consuming procedure, the effectiveness of which is dependent upon the skill of the installer. As a consequence, such procedure often does not consistently result in a wall covering in which the panel-to-panel identity is effectively concealed, and moreover, significant waste can be incurred.

In accordance with the invention, the panels have predetermined first and second laterally spaced cutting lines along which the panels may be alternatively cut to start alternative courses, whereby the simulated building elements in the lowermost row of each panel are automatically offset from the simulated building elements in the uppermost row of the panel immediately therebelow. To this end, in the illustrated embodiment, the panels 11 each have predetermined, laterally spaced first and second cutting lines A and B along which the panel may be cut to begin alternate courses during installation onto a wall or roof support surface. Such procedure, regardless of the experience or level of skill of the installer, will effect optimum consistent mounting of the panels with the separating grooves between individual simulated shake of each row being substantially offset laterally from the separating grooves in the immediately adjacent row of simulated shake by an appreciable distance, such as at least ¾ inch. As will be seen, cutting of the panels in such manner effects removal of the staggered edges of the panels, enables optimum installation of the entire course of panels, and minimizes and controls waste.

Figure 2:
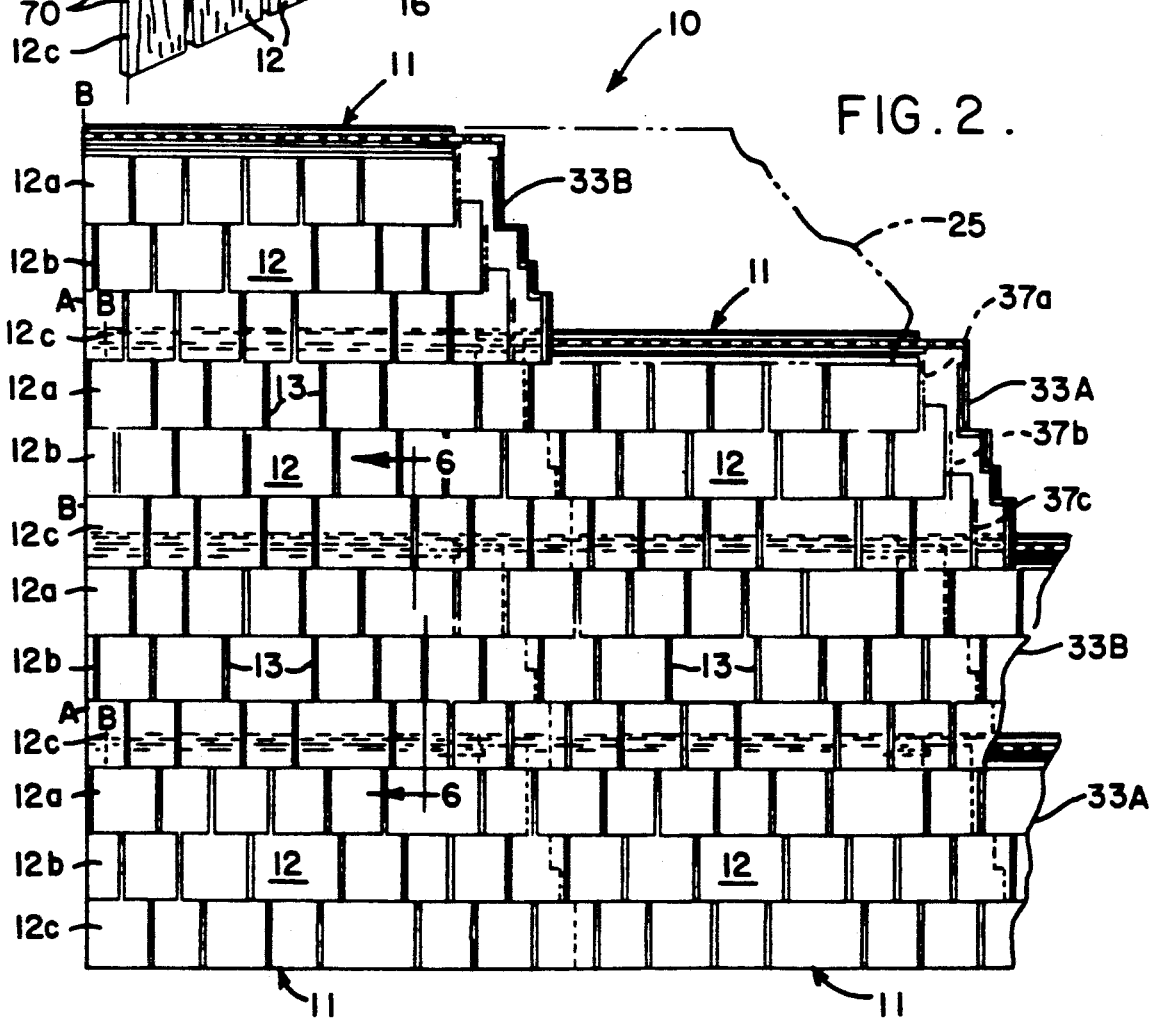
FIG. 2 is a plan view of several courses or rows of the panels which comprise the illustrated wall covering, shown in assembled relation to each other.

In the illustrated embodiment, as depicted in FIG. 2, the lowermost course of panels 12, designated 33A begins with a first panel 11 which has been cut along a first straight cutting line A and positioned adjacent the straight left-hand edge of the support surface 25. The first cutting line A in this instance is disposed in alignment with the left-hand peripheral edge of the first simulated panel of the lowermost row 12*c* and the groove 13 between the first and second shake in the uppermost row 12*c*. Hence, cutting of the shake along cutting line A removes only a portion of the simulated shake in the middle row 12*b* and one shake in the upper row 12*c*. The first panel in the second course, designated 13B is cut along the second predetermined cutting line B, which preferably is located a relatively short distance, such as on the order of 2 inches, from the first cutting line A. Cutting of the panel along the second predetermined cutting line B removes only slightly more of the panel than when cutting along line A, and again establishes a straight edge of the panel for positioning adjacent the edge of the support surface and, without skill or judgment on the part of the installer, automatically results in the separating grooves 13 between the simulated shake 12 of the lowermost row 12*c* of the shake to be laterally offset from the separating grooves 13 of the simulated shake in the uppermost row 12*a* of the course therebelow. Successive mounting of the identically formed panels to complete the second course 33B similarly results in automatic lateral offset positioning of the separating grooves 13 of the lowermost row 12C of panels for the entire course from the separating grooves 13 in the uppermost row 12*a* of panels for the underlying course. As shown in FIG. 2, continued alternate courses 33A, 33B are begun with panels alternatively cut along cutting lines A and B with the same result. Hence, the wall covering may be completed without the exercise of skill or judgment on the part of the installer in cutting of the panels to achieve the optimum esthetic appearance for the wall covering with a minimized and controlled amount of waste.

Figure 8:
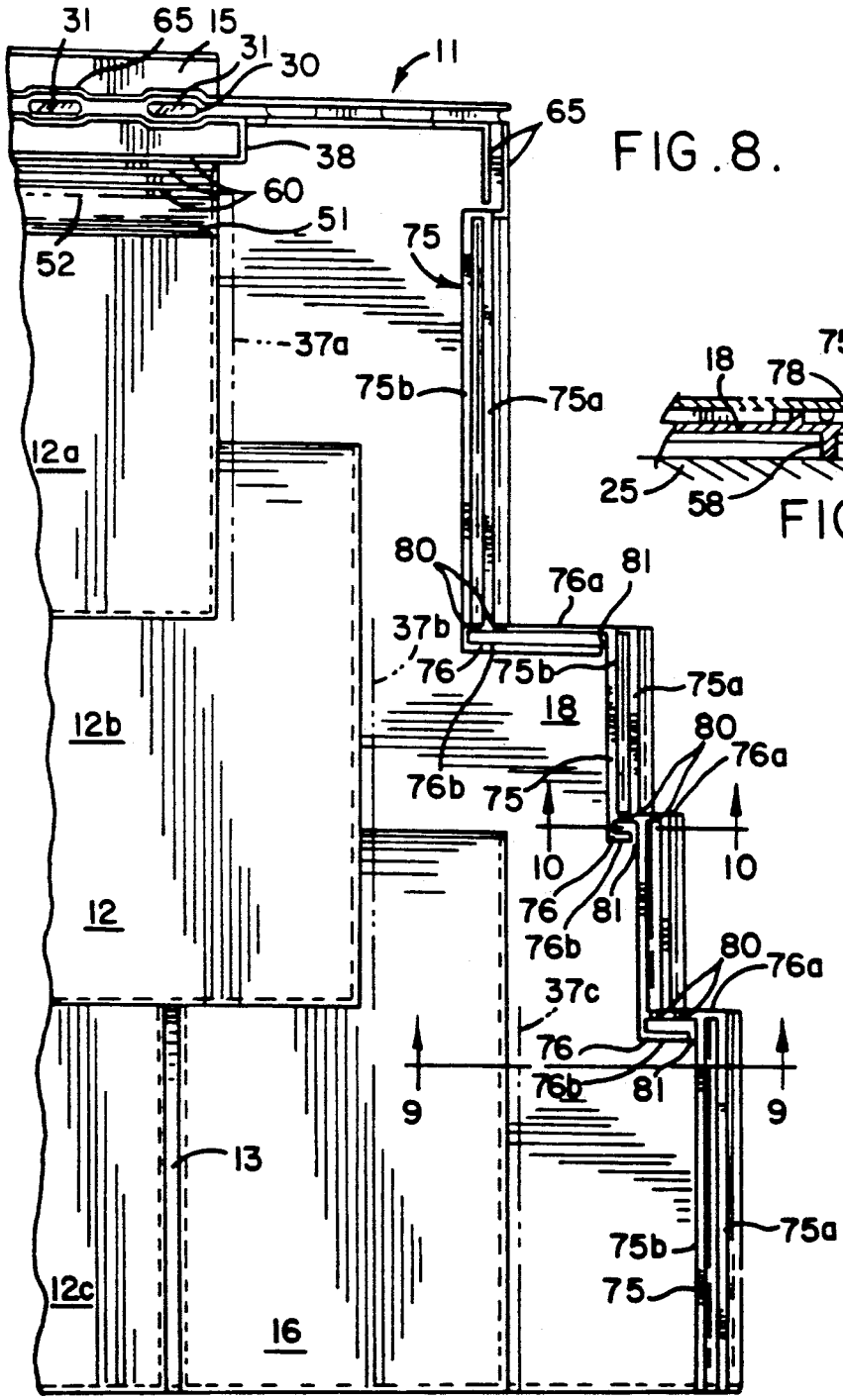
FIG. 8 is an enlarged face-side plan view of the right-hand portion of one of the illustrated panels.

In carrying out the invention, the panels further are adapted to facilitate consistent, predetermined overlapping mounting of the side marginal edge regions and prevent variances in the space or gap between the last shake of one panel and the first shake of the adjacent panel resulting from thermal expansion and contraction to detract from the esthetic appearance of the complete wall covering. To this end, to facilitate locating the left-hand peripheral edge of one panel 11 in properly overlapping relation onto the right-hand marginal edge region 18 of the previously mounted panel, the face of the right-hand marginal edge region 18 of each panel is formed with locating lines 37*a*, 37*b*, 37*c* immediately adjacent the last shake in each respective row 12*a*, 12*b*, 12*c* upon which the stepped left-hand marginal edge region of the next mounted panel is positioned (FIGS. 2 and 8). The locating lines 37*a*, 37*b*, 37*c* preferably are located in spaced relation to the right-hand peripheral edge of the last simulated shake in each row 12*a*, 12*b*, 12*c* a distance which corresponds approximately to the width of the fixed grooves 13 between simulated shake panels 12.

Figure 3:
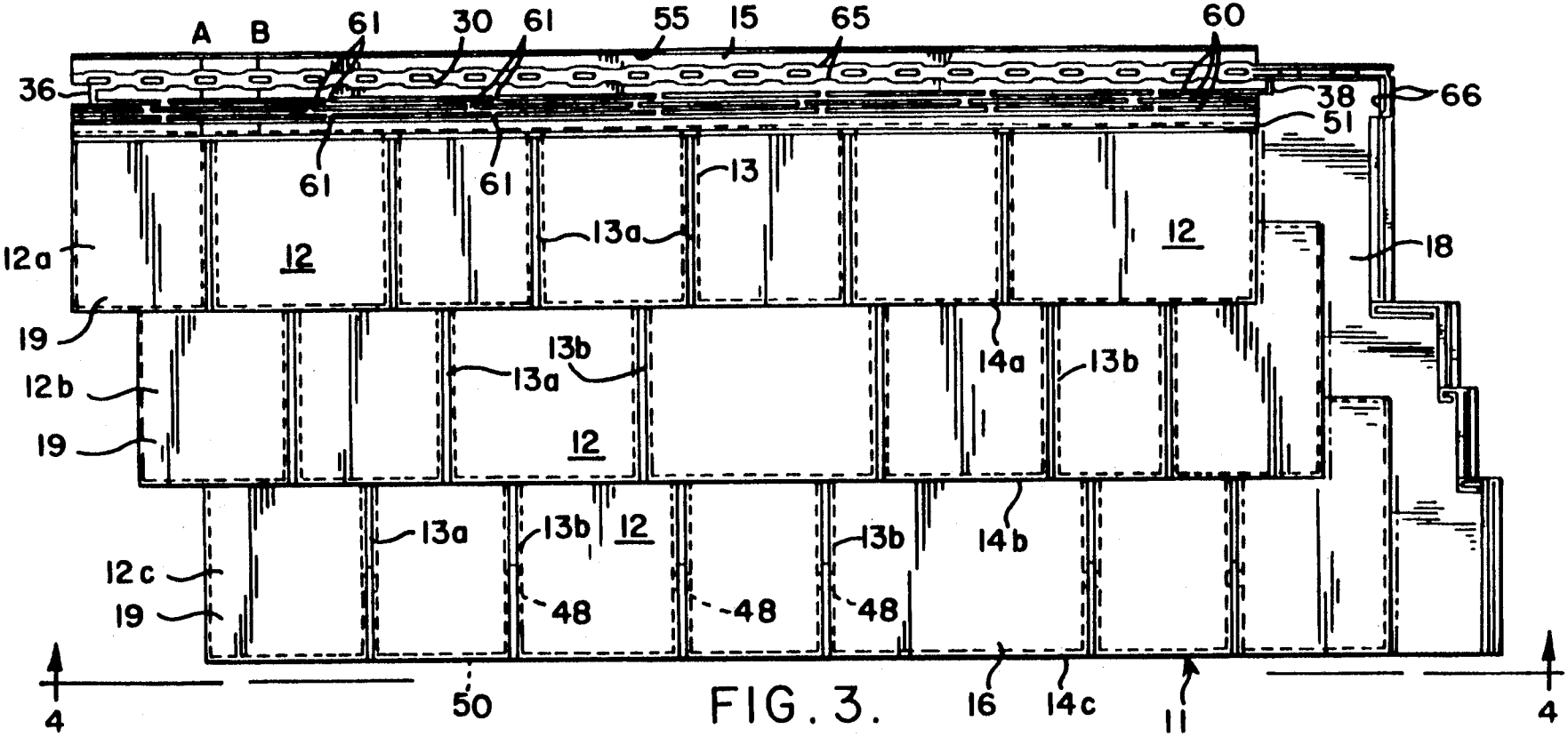
FIG. 3 is a plan view of the face-side of one of the panels of the illustrated wall covering.

In order that the variance in the spacing or gap 71 between the shake of adjacent panels from thermal expansion is less noticeable, the grooves 13 are formed of various widths, such as in the range of between ¼ and 5/16 inch. In the illustrated embodiment, the separating grooves 13 are of two distinct widths. As shown in FIG. 3, the grooves 13*a* are of one width, such as ¼ inch, and remaining separating grooves 13*b* in the panel are a slightly larger width, such as 5/16 inch. In practice, it has been found that by forming the separating grooves with such varying widths, even if the separating gap 71 between the last and first simulated shake of adjacent panels through thermal expansion becomes smaller than the width of the smaller grooves 13*a* or larger than the width of the larger grooves 13*b* it is unnoticeable to the eye of the casual observer and does not detract from the esthetic appearance of the wall covering.

To facilitate horizontal alignment of the panels 11 during mounting of each course, the upper marginal edge region 15 of each panel in this case is formed with an outwardly opening, generally rectangular configured locating slot 36 on the left-hand side thereof which is positionable onto a raised, generally rectangular locating lug 38 formed on the top right-hand side of the upper marginal edge region 15 of the previously mounted panel (FIGS. 3 and 9). The left-side marginal edge region 19 preferably is positionable onto the right-side marginal edge region 18 of the adjacent panel such that an expansion space or gap, on the order ¼ inch, remains between the end of the locating lug 38 and the end of the locating slot 36.

Figure 4:
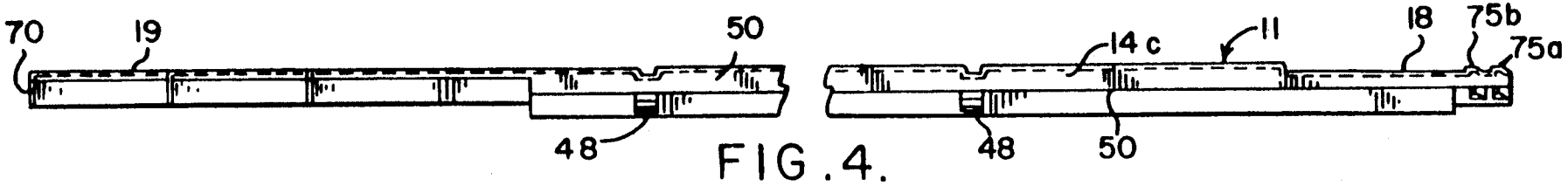
FIG. 4 is an enlarged bottom view of the panel shown in FIG. 3.

For forming a primary seal between the overlapping side marginal edge regions 18, 19 of adjacent panels 11, the stepped left-side peripheral edge of each panel is in the form of a stepped rearwardly directed sealing flange 70 adapted for positioning onto the face of the right-hand peripheral edge region 18 of the previously mounted panel with the sealing flange 70 in bearing engagement with the face of the marginal edge region 18 (FIGS. 1, 4 and 9).

Figure 5:
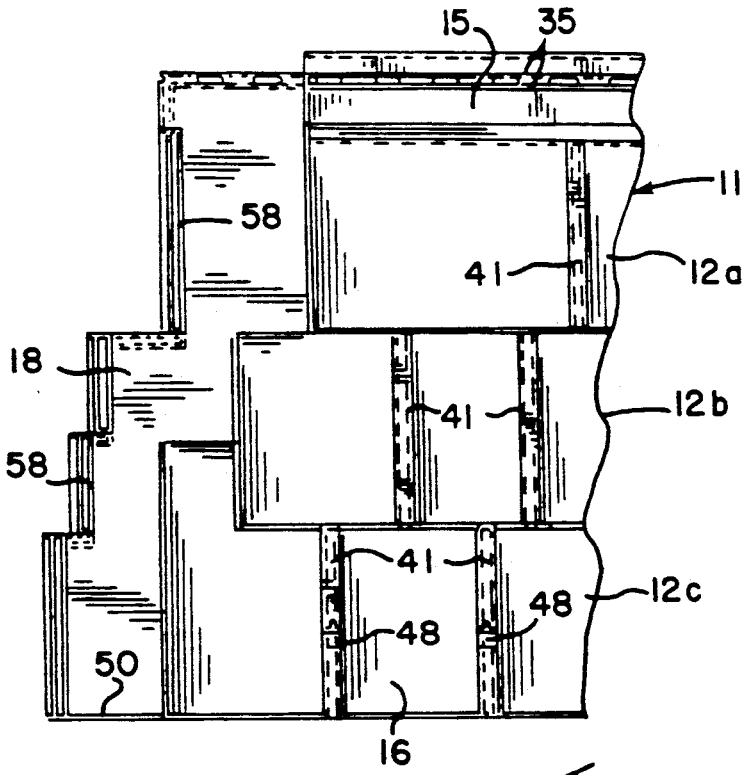
FIG. 5 is an enlarged rear-side plan view of a right-hand portion of the panel shown in FIG. 3.
Figure 6:
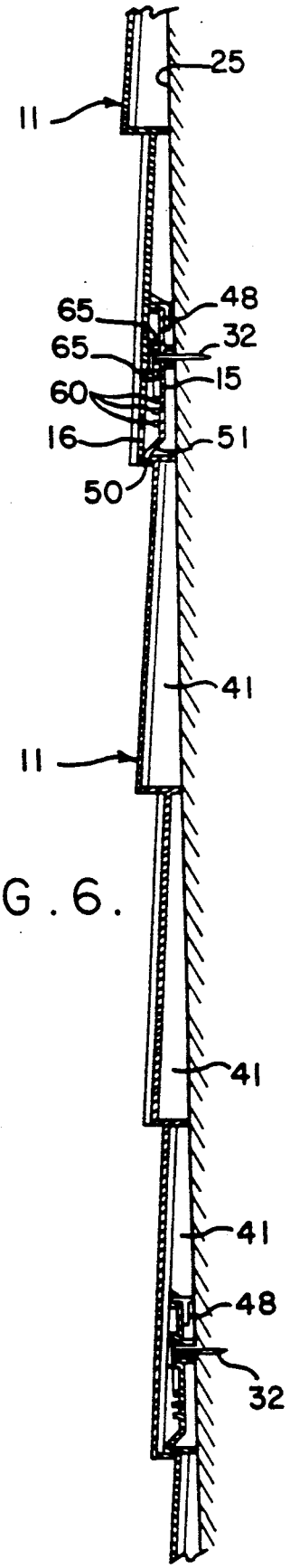
FIG. 6 is an enlarged fragmentary section of the illustrated wall covering, taken in the plane of line 6—6 in FIG. 2.

For providing firm support for the mounted panels on the wall and roof upon nailing and for establishing a seal between the rear side of the panel 11 and the support surface 25, the upper marginal edge region 15 is formed with a pair of rearwardly extending horizontal sealing flanges 35 which extend substantially the length of the upper marginal edge region 15 and which are disposed on opposite sides of the nailing apertures 30 (FIGS. 5 and 7). Once the upper marginal edge region 15 is nailed to the support surface, the horizontal sealing flanges 35 are maintained firmly against the support surface 25 and cannot be lifted from the support surface even during severe weather conditions.

For positively interlocking the lower marginal edge region 16 of each panel to the upper marginal edge region 15 of the panel nailed to the support surface 25 immediately below, the underside of each panel has a plurality of integrally formed, laterally spaced, downwardly directed hooks 48 adapted for engaging the upper peripheral edges of the panels in the course below. The hooks 48 in this instance are formed at the lower ends of rigidifying ridges 41 located rearwardly of the lowermost row 12*c* of simulated shake. To permit overlapping by the lower marginal edge region 16, the support ridges 41 for the lowermost row of shake 12*c* terminate in upwardly spaced relation to the lower peripheral edge of the panel 11.

For properly positioning the lower marginal edge region 16 of one panel in overlapping relation to the upper marginal edge region 15 of the panel immediately therebelow, the bottom peripheral edge of each panel is in the form of a downwardly turned lip 50 that is positionable against an upwardly directed locating ledge 51 formed on the face side of the upper marginal edge region 15 of the underlying panel adjacent the upper edges of the top row 12*a* of simulated shake 12. Upon mounting of the panel 11, as shown in FIG. 7, the lower peripheral edge of the lower row 14*c* of simulated shake 12 is disposed above the upper peripheral edge of the top row 12*a* of simulated shake of the panel immediately therebelow, again simulating the appearance of overlapping natural shake. To prevent the downwardly turned peripheral lip 50 of the upper panel from catching on the locating ledge 51 of the lower panel during mounting, the upper side of the locating ledge 51 is in the form of an inclined ramp 52 which will tend to guide the bottom peripheral lip 50 over the locating ledge 51 into proper position during installation.

Figure 10:
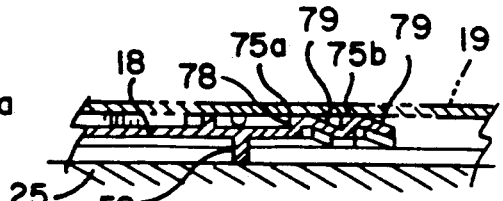
FIG. 10 is an enlarged fragmentary section, similar to FIG. 9, but taken in the plane of line 10—10 in FIG. 8.

For establishing seals between the overlapping bottom marginal edge region 16 of one panel and the upper marginal edge region 15 of the panel in the course immediately below, the downturned lower peripheral lip 50 bears against the face of the underlying panel to establish a primary seal 54 and the underlying panel has an upper peripheral edge in the form of an upwardly extending sealing lip 55 that is positionable into engagement with the underside of the lower marginal edge portion 16 of the overlapping panel to establish a secondary seal 56. The interlocking engagement of the upper marginal edge region 15 in the hooks 48 of the overlying panel retains the lips 50, 55 in sealing engagement to substantially prevent the entry of water into the space between the overlapping upper and lower marginal edge regions 15, 16. For providing firm support for the overlapping side marginal edge regions 15, 16, the right-hand marginal edge region 18 of each panel is formed with one or more depending support flanges 58 which are engageable with the support surface 25 (FIGS. 9 and 10).

In order to prevent capillary movement of water from entering the space between the overlapping marginal edge regions of the panels notwithstanding thermal expansion and contraction between the overlapping marginal edge regions, in the illustrated embodiment, water barrier means are defined between the regions. In the illustrated embodiment, a plurality of horizontal water barrier ridges 60 extend in upstanding relation from the face of the upper marginal edge region 15 of each panel 11. The barrier ridges 60 preferably are discontinuous in nature for impeding and slowing down the capillary movement of water upwardly between the overlapping upper and lower marginal edge regions 15, 16, while permitting effective drainage of the moisture in a downward direction in order to prevent moisture from being trapped between the panels, which might freeze and expand to interrupt and destroy the seals established between the marginal edge regions.

In the illustrated embodiment, three parallel barrier ridges 60 are integrally formed on the upper marginal region 15 of each panel between the locating ledge 51 and the nail apertures 30. The barrier ridges 60 each preferably are on the order of 1/16 to ⅛ inch in height and are disposed in vertically spaced relation to each other, with the lowermost barrier ridge 60 located in closely adjacent relation to the ramp 52 of the locating ledge 51. While the barrier ridges 60 extend substantially the length of the panel, they each are formed with a plurality of small drainage passages or openings 61 (FIG. 3). The drainage passages 61 for each barrier ridge are located in laterally offset relation to the drainage passages 61 of the adjacent ridge 60 so as to prevent a straight vertical path through the barrier ridges at any point which might permit unrestricted upward capillary movement of the water. The vertically spaced and laterally offset passages 61, however, enable gravity drainage of water downwardly in a circuitous path through the passages 61.

To further impede the capillary or creeping movement of water upwardly along the face of the upper marginal edge region 15 into the holes pierced by the mounting nails 32 and over the upper 20 peripheral edge of the panel 11, a pair of uninterrupted, upstanding nail aperture guard ridges 65 are integrally formed in the panel immediately adjacent top and bottom sides of the elongated nail apertures 30. The illustrated nail aperture guard ridges 65 extend the entire length of the upper marginal edge region 15. As a result, even water that may ultimately climb the multiplicity of barrier ridges 60 is impeded by the guard ridges 65 from entering the nail holes and reaching the upper peripheral edge of the panel. The nail aperture guard ridges 65 in this instance extend outwardly to the right-hand peripheral end of the panel 11 and communicate with a pair of laterally spaced vertical ridges 66 which facilitate downward drainage of moisture which may accumulate between the guard ridges 65.

For impeding water migration between overlapping side marginal edge regions 18, 19 of the panels, a plurality of vertical and horizontal water barrier ridges 75, 76, respectively, are integrally formed on the face side of the right-hand marginal edge region 18 of each panel immediately adjacent the stepped peripheral edge of the panel 11, the vertical barrier ridges 75 being in parallel relation to the vertical sides of the stepped peripheral edge and the horizontal barrier ridges 76 being in parallel relation to the horizontal portions of the stepped peripheral edge. In the illustrated embodiment, pairs of vertical barrier ridges 75*a*, 75*b* are provided, with a first barrier ridge 75*a* of each pair being disposed immediately adjacent a respective vertical edge of the stepped section and a second vertical barrier ridge 75*b* being inwardly disposed in parallel relation to the first. Each vertical barrier ridge 75 has a vertical side 78 which forms a barrier for preventing liquid migration in a direction from the face side of the panel outwardly toward the peripheral edge thereof (FIGS. 9 and 10). The other side of each vertical ridge 75 is in the form of a tapered ramp 79 extending from the top of the ridge in a downwardly inclined direction for facilitating assembly of a second panel 11 onto the right-hand marginal edge region 18 of the previously mounted panel 11 by preventing the downwardly turned sealing lip 70 on the left-hand side of the panel from catching upon the barrier ridges 75.

The transverse barrier ridges 76 also are formed in pairs. Each pair includes a first transverse barrier ridge 76*a* adjacent a respective transverse peripheral edge portion of the upper marginal edge region 18 and a second barrier ridge 76*b* disposed in downwardly spaced relation to the first. The first transverse barrier ridge 76*a* extends inwardly to a location under the pair of vertical barrier ridges immediately thereabove. The second transverse barrier ridge 76*b* of each pair is connected to the lowermost end of a respective vertical barrier ridge 75*b* and extends to a position in closely spaced relation near the upper end of the inner barrier ridge 75*b* adjacent the next downwardly stepped section of the panel.

The side barrier ridges 75, 76 again are adapted not only for impeding capillary movement of the water outwardly along the right-side marginal edge region, but to facilate drainage of water that may enter the space between the overlapping side marginal edge regions 18, 19. As can be seen, the vertical water barrier ridges 75 and the transverse water barrier ridges 76 define stepped drainage passageways, while preventing direct upward and transverse water migration. To this end, drainage openings 80 are provided in the transverse barrier ridges 76*a* at locations adjacent the bottom of the vertical barrier ridges 75 for permitting the drainage of water which may migrate over one or both of the vertical barrier ridges 75*a*, 75*b* (FIG. 9). The openings 80 direct water onto the transverse barrier ridge 76*b* which preferably extends downwardly from a horizontal relatively small angle of between 10° and 15° to facilitate direction and drainage of water through drainage openings 81 defined between the end of the transverse barrier ridge 76*b* and the adjacent vertical barrier ridge 75*b*. The drainage openings 80, 81 all are disposed in horizontally offset relation to each other so as to prevent a direct vertical path for the capillary movement of water. Hence, the vertical and transverse barrier ridges 75, 76 defined between the overlapping side marginal edge regions 18, 19, like the barrier ridges 60 between the overlapping top and bottom marginal edge regions 15, 16, both impede the migration of water outwardly over the peripheral edge of the panel, while facilitating drainage of moisture in a downward direction.

From the foregoing, it can be seen that the wall covering panels of the present invention are adapted for mounting with a more realistic and naturally esthetic appearance. The panels are adapted for quick and efficient mounting on a wall support surface with the simulated shake or like building elements of one panel automatically and esthetically offset laterally from the simulated shake of the panel immediately therebelow. Variance in spacing between simulated shake of adjacently mounted panels caused by thermal expansion and contraction also is substantially undetectable and does not detract from the appearance of the completed wall covering. The wall panels, moreover, are relatively simple construction, lend themselves to economical manufacture and easy failproof mounting, and provide an effective water barrier to the roof or wall.

I claim:

1. A wall covering for mounting on a support surface disposed at an angle to the horizontal comprising a plurality of identically molded panels each having a relatively thin body portion formed with at least one row of simulated building elements which each are separated by a groove, said panels each having upper and lower substantially horizontal marginal edge regions and right and left-side marginal edge regions, said panels being mountable on said support surface in a plurality of vertically spaced horizontal courses each starting from a common straight line on the support surface with the lower marginal edge regions of the panels in one course overlapping the upper marginal edge regions of the panels in the course immediately therebelow and with the left-side and right-side marginal edge regions of adjacent panels in overlapping relation to each other, said panels each having first and second predetermined laterally spaced vertical cutting lines, the first panel of-each alternate course in the vertical direction being cut along said first cutting line and positioned with the cut edge thereof adjacent said common straight starting line, and the first panel of every other course being cut along said second cutting line and positioned with the cut edge thereof adjacent said common starting line.

2. The wall covering of claim 1 in which said panels each include a plurality of horizontal rows of simulated building elements each having a separating groove therebetween, and the separating grooves of the lowermost row of simulated building elements of each panel being laterally offset from the separating grooves of the uppermost row of the course immediately therebelow.

3. The wall covering of claim 2 in which said rows of simulated building elements are partially offset laterally with respect to each other such that the side marginal edge regions of each panel are staggered, and said first cutting line is adjacent a left-hand end of a lowermost row of simulated elements and said second cutting line is a relatively short distance to the right thereof.

4. The wall covering of claim 2 in which said rows of simulated building elements are partially offset laterally with respect to each other with the lowermost row beginning to the right of the uppermost row and extending a further distance to the right than the uppermost row, and said first cutting line is adjacent a left-hand side of said lowermost row and said second cutting line is a relatively short distance to the right thereof.

5. The wall covering of claim 3 in which said second cutting line is laterally spaced a distance of about 2 inches from said first cutting line.

6. The wall covering of claim 2 in which said simulated building elements of each panel are shake shingles of varying widths.

7. The wall covering of claim 2 in which said panels each include three horizontal rows of building elements in the form of simulated shake of varying widths and each having a separating groove therebetween.

8. The wall covering of claim 3 in which the left-side marginal edge region of each panel is disposed in partially overlapping relation to the right-side marginal edge region of the immediately adjacent panel, and said right-side marginal edge region of each panel is formed with locating lines immediately adjacent the last simulated shake in each row.

9. The wall covering of claim 8 in which said locating lines are located in spaced relation to the last simulated shake in each row a distance corresponding approximately to the width of the separating grooves between the simulated shake panels.

10. The wall covering of claim 1 in which said overlapping upper marginal edge regions define water barrier means in the form of a plurality of parallel substantially horizontally disposed ridges for impeding the upward movement of water between said overlapping upper and marginal edge regions.

11. The wall covering of claim 10 in which said overlapping right-side and left-side marginal edge regions define water barrier means in the form of a plurality substantially parallel vertical of ridges for impeding the outward movement of water toward the peripheral edge of the right-side marginal edge region of each panel.

12. The wall covering of claim 2 in which said overlapping right-side and left-side marginal edge regions are formed with an interlockable lug and locating slot for assuring proper horizontal alignment of panels mounted in side-by-side adjacent relation.

13. The wall covering of claim 12 in which said locating slot is formed on the right-hand of the upper marginal edge region of each panel and the locating lug is located on the left-hand end of the upper marginal edge region of each panel.

14. A wall covering for mounting on a support surface disposed at an angle to the horizontal comprising a plurality of identically molded panels each having a relatively thin body portion formed with a plurality of horizontal rows of laterally spaced simulated shake shingles each separated by a fixed separating groove, said panels each having upper and lower substantially horizontal marginal edge regions and right and left-side marginal edge regions, said panels being mountable on said support surface in a plurality of vertically spaced horizontal courses each starting from a common straight line on the support surface with the lower marginal edge regions of the panels in one course overlapping the upper marginal edge regions of the panels in the course immediately therebelow and with the left-side and right-side marginal edge regions of adjacent panels in each course, being in overlapping relation to each other such that the last simulated shake panel in each row of one panel is separated from the first simulated shake in the adjacent panel by a gap corresponding approximately to that of the fixed grooves between said simulated shake shingles, and some of said fixed grooves between said simulated shake in each panel being of a first similar predetermined width and other of said fixed grooves in the panel being of a second similar predetermined width different from said first predetermined width.

15. The wall covering of claim 14 in which said first fixed grooves have a width of about ¼ inch and said other fixed grooves have a width of about 5/16 inch.

16. The wall covering of claim 15 in which said separating grooves of the lowermost row of simulated shake shingles each panel are laterally offset a distance of at least ¾ inch from the separating grooves of the uppermost row of simulated shake shingles of the panel immediately therebelow.

17. A method of installing a wall covering made of a plurality of horizontal courses of individual identically molded panels each having first and second predetermined laterally spaced cutting lines and each being formed with a plurality of horizontal rows of laterally spaced simulated building elements each separated by a groove, comprising the steps of cutting the first panel of each course along said first predetermined cutting line, mounting said panel on a support surface with the cut edge of said first panel adjacent a common straight starting line, mounting further of said panels in side-by-side partially overlapping relating to complete a first course beginning with said first cut panel, cutting the first panel of a second course along said second predetermined cutting line and mounting said panel on the support surface with the cut edge thereof adjacent said common starting line and with the lower marginal edge region of thereof partially overlapping the first panel of the first course, installing further panels in partially side-by-side overlapping relation to complete the said second course beginning with said first cut panel of said second course with the separating grooves between the bottom row of simulated building elements of the second course being laterally offset from the separating grooves of the top row of simulated building elements of the first course, and mounting further courses in vertically spaced relation to each other beginning each alternate course with a panel cut along said first predetermined cutting line and mounted adjacent said common straight starting line and each other course with a panel cut along said second predetermined cutting line and mounted with the cut edge thereof adjacent said common straight starting line.

18. The method of claim 17 in which said panels of each course are mounted in side-by-side relation with the separating groove of the lowermost row of simulated building elements being laterally offset a distance of at least ¾ inch from the separating grooves of the top row of simulated building elements of the course of panels immediately therebelow.

19. The method of claim 18 in which said first panels of said second course and said every other course are cut along said second cutting line which is located at a distance less than the width of said building elements than said first cutting line.

20. The method of claim 18 in which said first panels of said second course and said every other course are cut along said second cutting line which is located a distance of about 2 inches to the right of said first cutting line.

21. A method of installing a wall covering made of a plurality of horizontal courses of individual identically molded panels each having first and second predetermined laterally spaced cutting lines and each being formed with a plurality of horizontal rows of laterally spaced simulated shake shingles of varying widths each separated by a groove and with said rows being laterally offset partially with respect to each other such that the panels each have stepped right-side and left-side marginal edge regions, comprising the steps of cutting the first panel of each course along said first predetermined cutting line, mounting said panel on a support surface with the cut edge of said first panel adjacent a common straight starting line, mounting further of said panels in side-by-side partially overlapping relation to complete a first course beginning with said first cut panel, cutting the first panel of a second course along said second predetermined cutting line and mounting said panel on the support surface with the cut edge thereof adjacent said common starting line and with a lower marginal edge region thereof partially overlapping an upper marginal edge region of the first panel of the first course, mounting further of said panels in partially side-by-side overlapping relation to complete the second course beginning with said first cut panel of said second course with the separating grooves between the bottom row of simulated shake shingles of the second course being laterally offset from the separating grooves of the top row of simulated shake shingles of the first course and mounting further courses in vertically spaced relation to each other beginning each alternate course with a panel cut along said first predetermined cutting line and mounted adjacent said common straight starting line and each other course with a panel cut along said second predetermined cutting line and mounted with the cut edge thereof adjacent said common straight starting line.

22. The method of claim 21 including cutting the first panel of said first course and each said alternate courses along said first cutting line to form a straight cut edge of said panel without removing material adjacent the lowermost row of simulated shake elements, and cutting the first panel of said second course and said every other course along said second cutting line at a relatively short distance to the right of said first cutting line.

* * * * *